United States Patent [19]

Silhouette

[11] 4,420,289

[45] Dec. 13, 1983

[54] SYSTEM FOR SUCCESSIVELY PRODUCING HYDRAULIC FLUID FLOWS AT STAGGERED VALUES

[75] Inventor: Jean-Max M. Silhouette, Melun, France

[73] Assignee: Societe Nationale d'Etude et de Construction de Moteurs d'Aviation, "S.N.E.C.M.A.", Paris, France

[21] Appl. No.: 273,686

[22] Filed: Jun. 15, 1981

[30] Foreign Application Priority Data

Jun. 19, 1980 [FR] France ..... 80 13581

[51] Int. Cl.[3] ..... F04B 49/00

[52] U.S. Cl. ..... 417/216; 417/223; 417/319; 417/364

[58] Field of Search ..... 417/223, 216, 364, 319, 417/38, 215, 15

[56] References Cited

U.S. PATENT DOCUMENTS

| | | | |
|---|---|---|---|
| 906,659 | 12/1908 | Richards | 417/319 X |
| 2,779,291 | 1/1957 | Albright . | |
| 2,781,727 | 2/1957 | Marshall et al. . | |
| 2,821,698 | 1/1958 | Richardson . | |
| 2,992,769 | 7/1961 | Manzanera . | |
| 3,083,570 | 4/1963 | Truman | 417/44 X |
| 3,155,040 | 11/1964 | Shurts et al. | 417/223 |
| 3,985,468 | 10/1976 | Lewis | 417/223 X |

FOREIGN PATENT DOCUMENTS

| | | |
|---|---|---|
| 1503362 | 11/1973 | Fed. Rep. of Germany . |
| 2950256 | 6/1980 | Fed. Rep. of Germany . |
| 1545431 | 9/1968 | France . |
| 2046559 | 3/1971 | France . |
| 2234463 | 1/1975 | France . |
| 2247112 | 5/1975 | France . |
| 2253392 | 6/1975 | France . |
| 2271416 | 12/1975 | France . |
| 2307994 | 11/1976 | France . |
| 2304795 | 3/1980 | France . |
| 2950256 | 6/1980 | France . |

*Primary Examiner*—Edward W. Look

*Attorney, Agent, or Firm*—Oblon, Fisher, Spivak, McClelland & Maier

[57] ABSTRACT

The invention concerns a system for successively producing fluid flows at staggered values. This system includes for example an epicycloidal differential of which a shaft is coupled to an engine, and the other two shafts to two pumps respectively producing the maximum necessary flow and producing the minimum flow; to each pump is connected a brake; when the circuit, for example a jack, fed by this system becomes saturated, the pressure of the fluid sent by the high flow pump increases and reaches a threshold detected by a pressure detector-switch, the latter applies the brake which stops the pump and releases the brake of the other pump. The invention is applicable for example to feeding hydraulic jacks, in particular for turboshaft engines.

10 Claims, 7 Drawing Figures

SYSTEM FOR SUCCESSIVELY PRODUCING HYDRAULIC FLUID FLOWS AT STAGGERED VALUES

BACKGROUND OF THE INVENTION

1. Field of the Invention

The present invention concerns a system for successively producing hydraulic fluid flows at staggered values, intended for a utilization circuit, for example a hydraulic jack, requiring quickly varying fluid flows.

2. Description of the Prior Art

Many techniques use hydraulic installations in which the utilization circuit requires fluid flows that vary quickly between several staggered values, for example between a minimum value and a maximum value. This is the case in particular with a hydraulic jack, which, in order to maintain its load in a given position, requires a relatively weak flow, essentially corresponding to the leaks, while in order to move its load quickly it requires a much higher flow during load movement. Such demands are imposed, for example, on control systems for the variable-area primary ejection nozzle of a turbojet: these control systems must be capable of maintaining loads for long periods of time in addition to assuring very quick maneuvers.

In order to solve this problem, various solutions have already been contemplated. For example, it is possible to feed hydraulic fluid to the utilization circuit with a centrifugal pump capable of producing hydraulic fluid flows that can be quickly varied between staggered values. However, when the pump is working at a high rate and produces a weak flow, an important fraction of the driving energy is dissipated in overheating the pump and the hydraulic fluid; in this case, not only is the installation's output very poor, but the result is wear on the pump and its drive system. It would also be possible to utilize a pump producing a constant flow, of which only an appropriate fraction would be sent into the utilization circuit according to its needs for hydraulic fluid, the excess flow being, for example, sent back to the pump's inlet by means of an overpressure valve. Consideration may also be given to causing the pump's rotation speed to vary according to the needs of the utilizer circuit for the hydraulic fluid, for example by means of a suitable servo-control. However, this solution is not applicable in cases where the pump's speed must remain constant, for example when the pump drive motor must simultaneously drive other systems at constant speed. This is precisely the case with pumps intended to feed the control systems connected to the turbojets. Furthermore, it would be possible to imagine using an adjustable-flow displacement meter, such as a pump with a barrel piston-chamber, in which the inclination of the plate is reduced when the pump's lift pressure exceeds a given threshold. However, such a pump creates large friction losses, and its reliability is insufficient for certain applications, in particular in aeronautics.

The French Pat. No. 2 247 112 (POCLAIN) describes a system for simultaneously varying hydraulic fluid flows in two distinct utilization circuits with two pumps, which are driven by a single motor, and one of which has a variable capacity; when the priority needs for hydraulic fluid of one of the two utilization circuits increase significantly, in order to avoid stalling the single motor it is provided that the pump's capacity feeding the other utilization circuit will be reduced; thus the other utilization circuit then receives a hydraulic fluid flow that may momentarily be lower than its needs, which is not acceptable for certain applications.

The French Pat. No. 2 271 416 (POCLAIN) describes a feed system analogous to that described in the preceding patent but intended to feed a single utilization circuit with two pumps in parallel. For this purpose a variable-capacity regulator is provided for one of the two pumps, made in such a way that when it performs its regulating function the maximum power absorbed by the two pumps is constant and equal to the maximum power of the motor.

The French Pat. No. 1 545 431 (GENERAL ELECTRIC CO.) describes a fuel-feed system for the post-combustion system of a gas turbine engine having two centrifugal pumps with different flow capacities, which are continuously driven by the turbine's rotors. Fluid control systems and valves make it possible to feed first only the lower-flow pump, then only the high-flow pump, according to the turbine's running conditions. Each of the two pumps is thus constantly driven in rotation, even during periods when it does not have to deliver fuel, which leads to energy losses.

The French Pat. No. 2 234 463 (TRW INC.) describes a fuel pumping system having a centrifugal pump constantly driven in rotation and a displacement meter which is driven by means of a coupling only during the starting period when the centrifugal pump's pressurization is insufficient. This system is thus essentially aimed at compensating for the insufficient pressurization of a centrifugal pump working at low speed rather than delivering a fuel flow varying quickly between staggered values. The use of a coupling, subject to relatively fast wear, is also not desirable for the applications contemplated within the framework of the present invention and which have been previously mentioned.

The French Pat. No. 2 046 559 (ROBERT BOSCH) describes systems with several pumps in which the rotors, with parallel axes, are equipped for example with axial pistons controlled by fixed, inclined plates; gears make it possible at will to couple the rotors of at least two pumps to one another so as to obtain the drive of a single pump or two pumps with a single engine shaft. However, in the case for example of only two pumps, it is not possible to operate only the pump whose rotor is not cottered onto the engine shaft.

The French Pat. No. 2 307 994 (CHANDLER EVANS) describes a pumping system, in particular for feeding fuel to gas turbine engines, having two pumps with appreciably different flows that are driven by a single engine shaft, one directly and the other by means of a gearing. This system does not allow only the higher-flow pump to be operated, since the lower-flow pump is always in service. Furthermore, it has the drawback of utilizing a gearing subject to rapid wear.

SUMMARY OF THE INVENTION

The system according to the present invention for successively producing hydraulic fluid flows at staggered values likewise includes several rotary pumps with suitably staggered nominal flows driven by a single engine, as well as means for selectively switching each of said pumps between stopping and the nominal power. However, it has none of the drawbacks of the previous systems mentioned above.

In the system according to the present invention, the various pumps are coupled respectively to output shafts in a mechanical transmission which has one or more epicycloidal differentials mounted in series, the intake shaft of the first differential in the series being coupled to the engine, wherein a brake is connected to each of said pumps, and means are provided for controlling each brake when crossing a threshold determined by the pressure provided by said pumps.

Since it includes only one geared mechanical transmission to the exclusion of all couplings, the system according to the present invention offers a high degree of reliability and long life; its brakes work only infrequently i.e., whenever a pump previously in service stops. To this are added the following advantages: the power of the single engine may be appreciably lower than the power which would be necessary to drive a single pump having to supply by itself the maximum flow required under the maximum pressure required, which results in a substantial savings in the installed power as well as in energy consumption; in addition, the excess power is prevented from being dissipated in overheating the pump and the hydraulic fluid, which also results in increased reliability and life for the system.

In its principal application, the system according to the present invention makes it possible to send a hydraulic fluid flow into a single utilization circuit, the flow being quickly switchable between two values, maximum and minimum, respectively. For this application, the system according to the present invention is characterized by the fact that two pumps with different nominal flows, coupled respectively to the two output shafts of a single epicycloidal differential, deliver a flow in parallel in the intake of the utilization circuit, and that means are provided to control two brakes each connected to one of the two pumps by the crossing of a threshold determined by the pressure at the intake of the utilization circuit. This embodiment, being particularly simple and reliable, is perfectly suited to feeding, for example, a high-pressure hydraulic jack requiring fluid flows that may vary rapidly between a maximum value and a minimum value, for example for the previously mentioned aeronautical applications.

A preferred embodiment of the system according to the present invention, specially intended for the application just indicated, includes in a single unit an epicycloidal differential, an intake shaft coupled to a first axis of the differential, two rotary pumps coupled respectively to the second and third axes of the differential, and at least one brake connected to each of the two pumps. Such a system, being particularly light, reliable and compact, is very well adapted to aeronautical applications by virtue of these qualities.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

Figure 1:
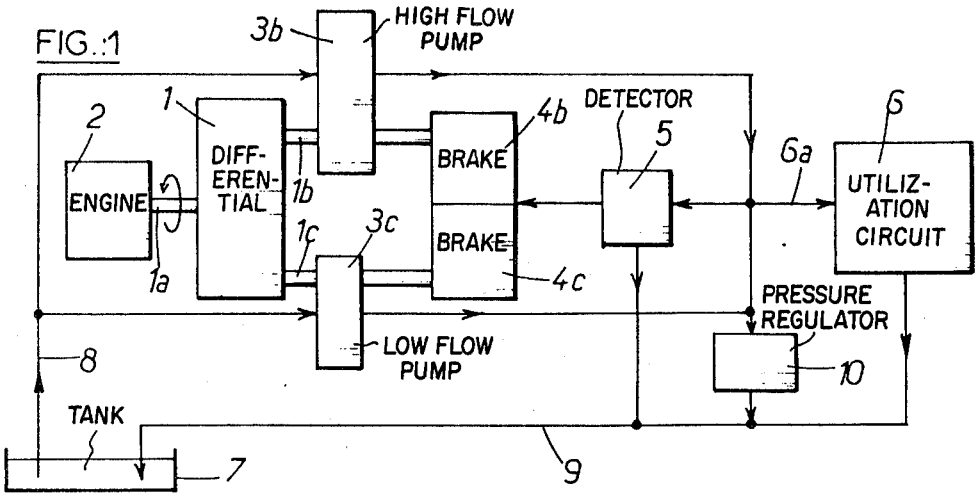
FIG. 1 is a block diagram of the first embodiment which is specially intended to feed hydraulic fluid to a utilization circuit requiring fluid flows varying quickly between a minimum value and a maximum value.

In FIG. 1, 1 designates an epicycloidal differential having an input shaft 1*a* and two output shafts 1*b* and 1*c*. The rotation speeds N of these three shafts of the differential 1 are related by a linear relationship in the following manner:

$$Na = B.Nb + C.Nc,$$

in which B and C are constant coefficients, positive or negative depending on the characteristics of the gearings constituting the differential 1. To intake shaft 1*a* is coupled the shaft of an engine 2, of any type whatever, of which we shall designate the rotation speed by $N_0$. To the output shafts 1*b* and 1*c* of the differential 1 are coupled the respective axes of a principal high-flow pump 3*b* and an auxiliary low-flow pump 3*c*. On the respective axes of the pumps 3*b* and 3*c* brakes 4*b* and 4*c* of any type may act; their control means are embodied according to the present invention in such a way that control of the application or release of the brake 4*b* is synchronized with control of the application or release of the brake 4*c*. These synchronized control means of the two brakes 4*b* and 4*c* receive a signal for application of one and simultaneous release of the other—from the outlet of a detector 5 for a threshold of the pressure at the intake 6*a* of a utilization circuit 6; to said intake 6*a* are connected in parallel the respective outlets of the pumps 3*b* and 3*c*. Numeral 7 designates a hydraulic fluid tank into which go a feed-pipe 8, connected in parallel to the intakes of the two pumps 3*b* and 3*c*, and a return pipe 9, to which are connected in parallel the outlet of the threshold pressure detector 5 (at least if it is working hydraulically), as well as of the utilization circuit 6; a pressure regulator 10 is inserted between the intake 6*a* of the utilization circuit 6 and the return pipe 9.

Figure 2:
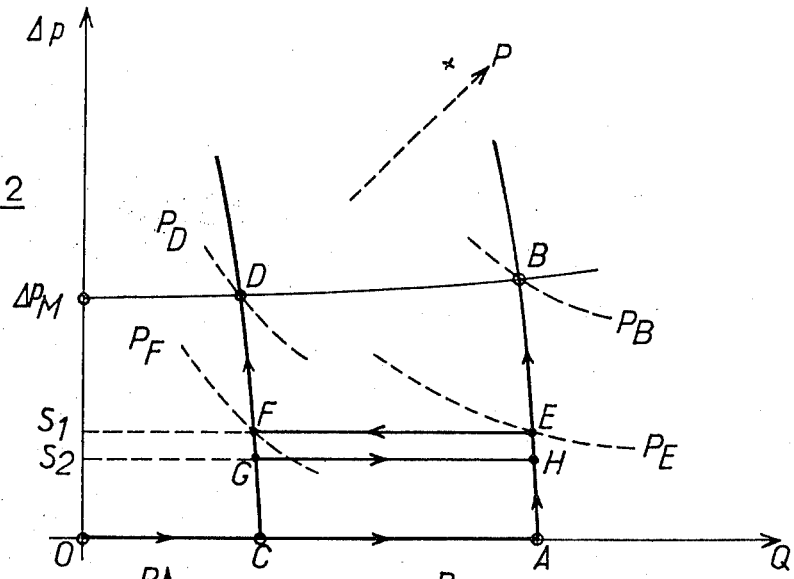
FIGS. 2 and 3 are diagrams intended to illustrate the operation of the system in FIG. 1 by showing its advantages.
Figure 3:
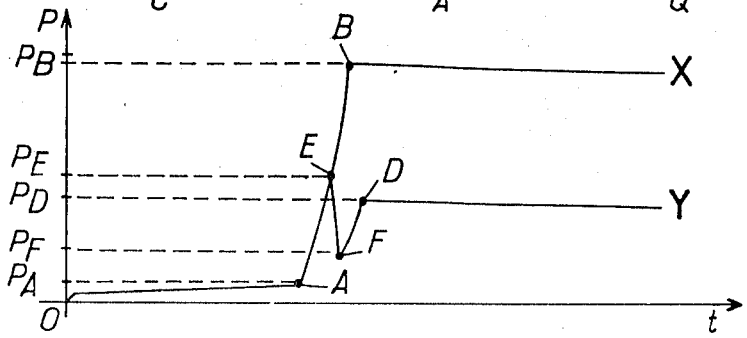

With the aid of FIGS. 2 and 3, we shall now explain the functioning of the system in FIG. 1, in the case—taken by way of example—where the utilization circuit 6 is a hydraulic liquid accumulator, in which the liquid must be kept at a maximum pressure determined by the pressure regulator 10 despite intermittent withdrawals of the liquid contained in said accumulator. In the diagram in FIG. 2, the abscissa is the hydraulic fluid flow Q at the intake 6*a* of the accumulator 6 at a given moment and the ordinate is the pressure $\Delta p$ of the hydraulic fluid in the accumulator, or at its intake 6*a*. During the starting phase of the engine 2, its speed grows from the value 0 to the value $N_0$. The brake 4c of the auxiliary pump 3c is applied, while the brake 4b of the principal pump 3b is released; only the latter delivers into the intake 6a of the accumulator 6. As the principal pump 3b is then driven in rotation at the speed $$Nb = Na/B,$$

the fluid flow sent by said pump 3b into the accumulator 6 increases progressively to a value corresponding in FIG. 2 along the abscissa to the point A and proportional to the drive speed of the pump 3b, $N_O/B$, hence also to the speed $N_0$ of the engine. During this starting phase, the accumulator 6 is filled with hydraulic fluid at a pressure virtually equal to the atmospheric pressure ($\Delta p=0$). As the engine 2 continues to drive the principal pump 3b at its speed $N_0$, its flow ceases to increase, and the pressure of the liquid filling the accumulator 6 increases progressively beyond the atmospheric pressure to a first given threshold S1, which corresponds in FIG. 2 to the ordinate of the point E. As soon as the hydraulic pressure detector 5 has detected this first threshold S1, it sends to the brakes 4b, 4c a signal which simultaneously controls the application of the brake 4b and release of the brake 4c. At this point, the principal pump 3b stops delivering into the accumulator 6, which is fed solely by the auxiliary pump 3c; as the latter is driven in rotation by the engine 2 at its speed $N_0/C$, proportional to the speed $N_0$ of said engine 2, the fluid flow which the auxiliary pump 3c introduces into the accumulator 6 has its nominal value, corresponding to the minimum flow provided for; in FIG. 2, this minimum flow corresponds to the abscissa of the point F. The flow from the auxiliary pump 3c into the accumulator 6 then causes a rise in the pressure in the accumulator from the threshold S1, corresponding to the point F in FIG. 2, to the maximum pressure $\Delta p_M$, which is determined by the overpressure valve 10 and which, in FIG. 2, corresponds to the ordinate of the point D. The accumulator 6 is then filled with hydraulic fluid at the maximum pressure. If liquid at this pressure is then taken from the accumulator 6, the flow from the pump 3c is insufficient to prevent the pressure of the liquid remaining in the accumulator 6 from dropping to the value corresponding to the first threshold S1, and even to a value S2, which in FIG. 2 corresponds to the ordinate of the point G; the pressure detector 5, in order to be sensitive to decreasing pressures, reacts at decreasing pressures to this second threshold S2, lower than the first threshold S1 to which it is sensitive when it detects increasing pressures. In other words, the pressure detector 5 is made to react by a phenomenon of hysteresis, and we shall later describe a possible embodiment for it. Upon its detecting the second pressure threshold S2, the detector 5 sends to the brakes 4b, 4c a signal, which simultaneously causes the application of the brake 4c and release of the brake 4b. The auxiliary pump 3c is subsequently stopped, and the principal pump 3b again sends into the accumulator 6 a hydraulic fluid flow corresponding in FIG. 2 to the abscissa of the point H, and at a pressure corresponding to the ordinate, S2, of the point H. When the withdrawal of hydraulic fluid ceases, the pressure of the hydraulic fluid contained in the accumulator again reaches the first threshold S1, which has the effect of controlling through the detector 5 the stopping of the principal pump 3b and the putting into service the auxiliary pump 3c, bringing the liquid filling the accumulator 6 back to its maximum pressure $\Delta P_M$.

In FIG. 2, hyperbolic arcs have been indicated in broken lines passing respectively through the points E, F and D of the diagram, as well as through point B, which corresponds to the case in which the liquid filling the accumulator 6 is brought to its maximum pressure by the flow from the principal pump 3b alone. These hyperbolic arcs are parts of equal power curves corresponding respectively to the powers $P_E$, $P_B$, $P_D$ and $P_F$ supplied by the system in FIG. 1 when its operating point is found respectively at E, B, D and F. Of course, the power supplied is greater as the corresponding hyperbolic arc is moved away from the origin 0 of the coordinates. In FIG. 3, the abscissa is the time t beginning with the moment of the start of the engine 2 of the system in FIG. 1, and the ordinate is the power P supplied by this system. If the accumulator had been filled with hydraulic fluid at the maximum pressure $\Delta P_M$ by making the principal pump 3b alone deliver constantly into the accumulator 6, the power supplied would have varied according to the curve O A E B X. In the previously described case of the alternating working of the pumps 3b and 3c, the power supplied varied according to the curve O A E F D Y. As the energy supplied by the system corresponds in each case to the area between the power P variation curve and the axis of the abscissa t, it can be easily seen in FIG. 3 that the alternating working of the pumps of the system in FIG. 1 allows a very significant energy savings in the case of use of a single pump. Furthermore, the use of a single pump, for example 3b, would require that it and the engine 2 be sized so that they could supply with the same efficiency a maximum power $P_B$, whereas recourse to two pumps 3b and 3c makes it possible to size the more powerful pump 3b and the engine 2 such that they can produce with the same efficiency only a maximum power $P_E$, which is much lower than the power $P_B$ to be taken into consideration in the case of a single pump, for example half of power $P_B$. Added to the energy savings is thus a very significant savings in installed power.

It can be clearly seen from the preceding description of the operation of the system illustrated in FIG. 1 that the threshold pressure detector 5 may be of any type whatever, so long as it is adapted to the brakes 4b and 4c. For example, in the case of electromagnetic brakes, the pressure detector 5 must be made so as to transmit a first electrical signal controlling the application of the brake 4b and release of the brake 4c when it detects the passage of an increasing pressure past the first threshold S1, and a second electrical signal controlling release of the brake 4b and the application of the brake 4c when it detects the passage of a decreasing pressure past the second threshold S2.

Below we shall describe one embodiment of the threshold pressure detector 5 in which this detector is combined with a pressure switch, making it possible to utilize the hydraulic fluid pumped by one of the two pumps, 3b, 3c to control the application of its brake and the release of the other pump's brake by a hydraulic jack, one embodiment of which will be described with the aid of FIG. 6.

Figure 4:
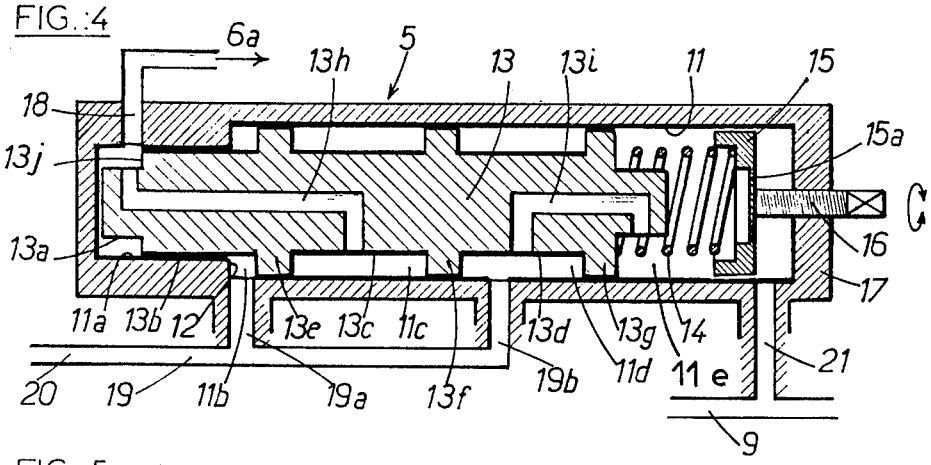
FIG. 4 is a sectional view on an axial plane of one embodiment of the threshold pressure detector, combined with a pressure switch, comprising part of the system illustrated in FIG. 1.
Figure 5:
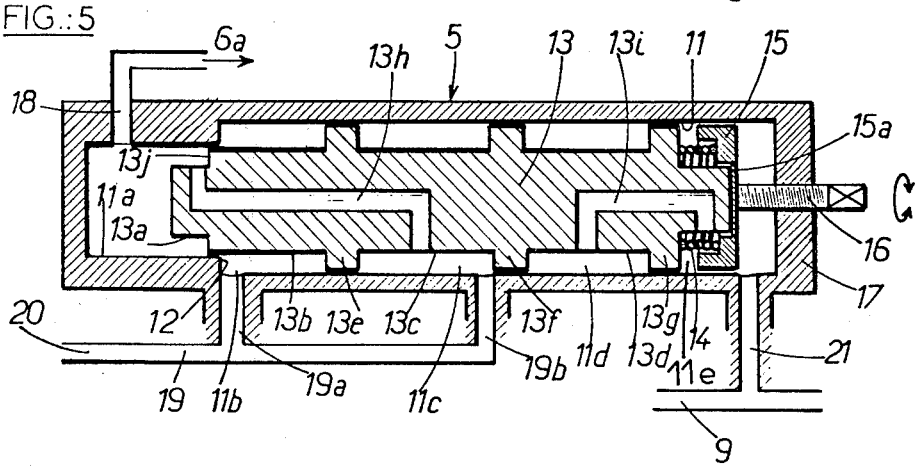
FIG. 5 corresponds to FIG. 4 for another position of the slide of the detector-switch.

In FIGS. 4 and 5, 11 designates a cylindrical chamber which is formed in a fluid-tight housing and which is preceded by an antichamber 11a, likewise cylindrical but of a slightly smaller diameter, in such a way that it is joined to the chamber 11 by an annular bearing 12. In the cylindrical chambers 11, 11a is mounted a freely sliding slide valve 13 shorter than the sum of the lengths of said chambers; on the side of the antichamber 11*a*, the slide valve 13 has first of all a cylindrical section 13*a* with a diameter slightly smaller than that of the antichamber 11*a*, and, beyond this section 13*a*, cylindrical sections 13*b* to 13*d*, of which at least the first is of the same diameter as the antichamber 11*a* so as to assure tightness while allowing the slide valve 13 to slide freely. Between the sections 13*b* to 13*d*, the slide valve 13 has annular rims 13*e* to 13*g* which are sized so as to assure tightness with the wall of the chamber 11 while allowing the slide valve to slide freely. Of course, known gaskets may be provided at the sections 13*b*, 13*e*, 13*f* and 13*g* of the slide valve 13. The latter thus delimits within the chamber 11 compartments 11*b*, 11*c* and 11*d*, which are insulated from one another as well as from the antichamber 11*a*. In the body of the slide valve 13 are placed a first passage 13*h* which permits the antichamber 11*a* to communicate with the compartment 11*c*, and a second passage 13*i*, which permits the compartment 11*d* of the chamber 11 to communicate with the rear compartment 11*e*. In the latter is placed a helical spring 14 which is supported on one side on the base of the annular rim 13*g* of the slide valve 13 and on the other side on a cap 15, itself borne by the end of a threaded rod 16 screwed tightly into a hole tapped in the rear wall 17 of the housing of the detector 5. In this housing are also placed a passage 18, which makes it possible to bring into the antichamber 11*a* the instantaneous pressure present at the intake 6*a* of the utilization circuit 6, a passage 19 which is joined on one side by off-takes 19*a* and 19*b* respectively to the compartments 11*b* and 11*d* or 11*c*, and on the other side to a pipe 20 ending at a hydraulic jack controlling the brakes 4*b* and 4*c*, as well as a passage 21 linking the rear compartment 11*e* of the chamber 11 to the return pipe 9 (see also FIG. 1).

The pressure detector-switch illustrated in the FIGS. 4 and 5 functions as follows: so long as the pressure at the intake 6*a* of the utilization circuit 6 is lower than the first threshold S1, this pressure, which is also present in the antichamber 11*a* and, through the passage 13*h*, in the compartment 11*c*, is insufficient to overcome the thrust of the compressed spring 14, so that the latter keeps the left end of the slide valve 13 pressed against the corresponding terminal surface of the antichamber 11*a*, as illustrated in FIG. 4. Like the return pipe 9, the rear compartment 11*e*, the passage 13*i* of the slide valve 13, the compartment 11*d*, the passages 19*b*, 19, 19*a*, 20 and the compartment 11*b* are then filled with hydraulic liquid at atmospheric pressure, so that the hydraulic jack controlling the brakes 4*b* and 4*c* is not actuated, which corresponds to the application of the brake 4*c* and release of the brake 4*b*. When the pressure at the intake 6*a* of the utilization circuit 6 approaches the first threshold S1 (point E in FIG. 2), the sum of the forces which the pressure present in the antichamber 11*a* exerts on the left face and the annular rim 13*j* of the slide valve becomes sufficient to move said slide valve 13 towards the right of FIG. 4. As soon as the annular rim 13*j* of the slide valve 13 has, in its movement towards the right in FIG. 5, placed the off-take 19*b* in communication with the compartment 11*c*, the pressure S1 is likewise present in the off-take 19*a* and in the compartment 11*b*; thus, while previously—for example in the initial position in FIG. 4—the sum of the pressure forces exerted on the two surfaces perpendicular to the axis of the slide valve 13 of the radial rim 13*e* was exactly equal to and in a direction opposite, the sum of the pressure forces exerted on the two faces of the annular rim 13*f*, beginning with the position illustrated in FIG. 5 the pressure forces exerted on the two faces of the annular rim 13*e* have a zero sum, so that the sum of the pressure forces exerted on the two faces of the annular rim 13*f* stops being balanced thereby and is added to the sum of the pressure forces exerted in the antichamber 11*a* by the pressure S1 to accelerate the movement of the slide valve 13 towards the right in FIG. 5. This movement continues until the right end of the slide valve 13 comes in contact with a stop 15*a* placed in the center of the cup 15 of the spring 14. As soon as the slide valve occupies its position of FIG. 5, hydraulic fluid at the pressure S1 is transmitted by the circuit 18, 11*a*, *l* 13*h*, 11*c*, 19*a*, 19*b*, 19, 20 to the hydraulic jack, which immediately controls the application of the brake 4*b* and the release of the brake 4*c*. Because of the aforementioned acceleration in the movement of the slide valve 13, the switching of the pressure present in the pipe 20 from the minimum valve (for example, atmospheric pressure) to the control value S1 takes place so quickly that the time during which the two pumps 3*b* and 3*c* are driven simultaneously by the engine 2 is reduced to the minimum. A very rapid switching is thus obtained in the hydrualic liquid flow sent into the intake 6*a* of the utilization circuit 6 from its maximum value, corresponding to the abscissa of the point E in FIG. 2, to its minimum value, corresponding to the abscissa of the point F.

With the slide valve 13 occupying its far right position, shown in FIG. 5, if the pressure at the intake 6*a* of the utilization circuit 6 decreases to the value S1, the drawback force exerted by the spring 14 is not yet sufficient to overcome the sum in the opposite direction of all the pressure forces applied to the slide valve 13, in particular because of the imbalance in pressure forces exerted on the faces of the annular rim 13*f*. Hence it is only when the pressure at the intake 6*a* of the utilization circuit 6 approaches the value of the second threshold S2, lower than S1, that the thrust of the spring 14 can overcome the sum of the pressure forces applied on the slide valve 13 and begin to move it towards the left in FIG. 5; this movement of the slide valve 13 is strongly accelerated when the annular rim 13*f* of the slide valve 13 has, in its movement towards the left, placed the off-take 19*b* back in communication with the compartment 11*d*, which has the effect not only of emptying the hydraulic jack controlling the brakes 4*b*, 4*c* via the circuit 20, 19, 19*b*, 11*d*, 13*i*, 11*e*, 21, 9 but also of reestablishing atmospheric pressure in the compartment 11*b* by means of the off-take 19*a* of the passage 19; this has the effect of again balancing the sum, directed towards the right, of the pressure forces exerted on the faces of the annular rim 13*f*, and consequently of reducing the sum of the pressure forces exerted on the slide valve 13. Thus the latter very quickly resumes its extreme left position, shown in FIG. 4, and, simultaneously, the brake 4*c* is applied and the brake 4*b* is released, which puts the principal pump 3*b* back into service; the switch 5 thus produces a very fast switching of the flow sent into the intake 6*a* of the utilization circuit 6 from its minimum value, corresponding to the abscissa of the point G in FIG. 2, to its maximum value, corresponding to the abscissa of the point H, as soon as the detector 5 has detected the drop in pressure at the intake of the utilization circuit to the value of the second threshold S2, lower than the first threshold S1. Of course, the value of the first threshold S1 may be adjusted by adjusting the minimum compression of the spring 14 by rotating the threaded rod 16 outside the housing of the detector 5.

Figure 6:
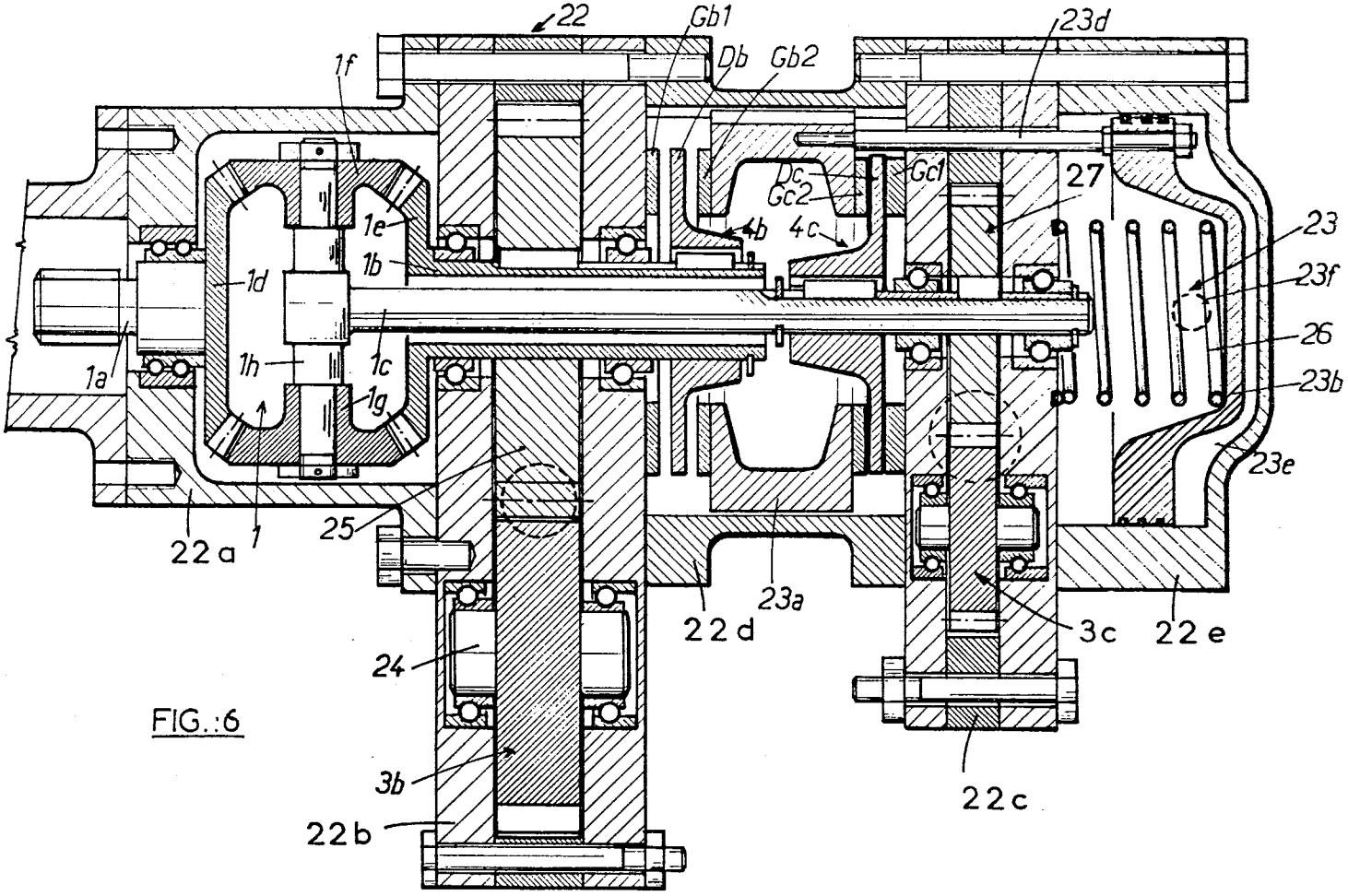
FIG. 6 is a sectional view on an axial plane of a periphery compact embodiment of the system in FIG. 1, in which the principal components, with the exception of the detector-switch, are grouped together in a single unit.

The system illustrated in FIG. 6 is a unit 22 having in connected housings 22*a* to 22*e* an epicycloidal differential 1, of which the first axis 1*a* is coupled to an intake shaft which itself may be coupled to any engine shaft, two rotary pumps, one 3*b* with a higher flow which is coupled to the second axis 1*b* of the differential 1 and the other 3*c*, with a lower flow, which is coupled to the third axis 1*c* of the differential 1, as well as two disk brakes 4*b* and 4*c*, connected respectively to the pumps 3*b* and 3*c*, and in particular to the axes 1*b* and 1*c* to which they are respectively coupled, and finally a hydraulic jack 23 which simultaneously and in opposite phase controls the two disk brakes 4*b* and 4*c*.

In the embodiment illustrated, the epicycloidal differential 1 consists essentially of a plate 1*d* with conical teeth and cottered onto the first axis 1*a*, a rim 1*e* with the same diameter and the same conical teeth as the plate 1*d* and fixed to the second axis 1*b*, itself tube-shaped, as well as two spider pinions 1*f* and 1*g* cottered between the plate 1*d* and the rim 1*e* on the same radial axis 1*h* so as to mesh simultaneously with the respective teeth of said plate and of said rim; the third axis 1*c*, which is inside and coaxial to the second tubular axis 1*b* and longer than it, is attached by one end to the radial axis 1*h* of the spider pinions and forms an extension of the first axis 1*a* of the differential. The pumps 3*b* and 3*c* are, for example, geared displacement meters. The pinion of the principal pump 3*b* is cottered onto a shaft 24, mounted to turn freely in the housing, and it is driven in rotation by a pinion 25 keyed onto the end part of the third axis 1*c* of the differential 1, which extends beyond the second, tubular axis 1*b*. The supports of the disks Db, Dc of the two brakes 4*b*, 4*c* are keyed respectively onto the second and third axis 1*b* and 1*c* of the differential 1; these disks are themselves arranged in a cylindrical chamber of the housing 22*d*, which is interposed between the two pumps 3*b* and 3*c*; the fixed packing rings Gb1 and Gc1 of the two brakes 4*b* and 4*c* are facingly oppositely attached to the end parts of the aforementioned chamber at the level of the corresponding disks; the movable packing rings Gb2 and Gc2 of the two brakes 4*b* and 4*c* are furthermore mounted back-to-back between the two corresponding disks Db and Dc on an annular part 23*a* which is itself coupled to the piston 23*b* of the hydraulic control jack 23 by at least one threaded rod 23*d* for rectilinear movement parallel to the axis 1*c*. The chamber 23*e* of the jack 23 is itself placed in the housing 22*e* at the end opposite that on which the differential 1 is mounted; its piston 23*b* preferably has the shape of a cup on the bottom of which is supported a return spring 26. 23*f* designates the outlet of the feed tube into the chamber 23*e* of the jack, which may be connected for example by a pipe 20 to the channel 19 of the pressure detector-switch 5 illustrated in FIGS. 4 and 5 and previously described. When atmospheric pressure is present in the chamber 23*e* of the control jack, its piston 23*b* is held by the spring 26 in its extreme right position, illustrated in FIG. 6; via the threaded rod 23*d*, the piston 23*b* then applies the movable packing ring Gc2 to the disk Dc of the brake 4*c*, which has the effect of keeping the auxiliary pump 3*c* stopped; as the movable packing ring Gb2 is simultaneously moved away from the disk Db of the brake 4*b*, the latter is released, so that the motor of the principal pump 3*b* turns freely. As soon as sufficient pressure is established through the tube 23*f* in the chamber 23*d* of the jack, its piston 23*b* moves towards the left in FIG. 6, compressing the spring 26, so that the rod 23*d* moves the annular part 23*a* so as to release the brake 4*c* and to apply the brake 4*b*, which produces the switching of the pumps 3*b* and 3*c*.

The embodiment illustrated in FIG. 6 is susceptible to many variants all forming part of the present invention. In the case of the differential with conical pinions illustrated in FIG. 6, the rotation speeds of the three axes 1*a* to 1*c* are related by the linear relationship:

$$Na = -Nb + 2Nc$$

in such a way that, when the intake shaft 1*a* is driven at the speed $N_0$ of the engine, the pump 3*b* turns in the opposite direction to the engine at the same speed $N_0$, and the pump 3*c* turns in the same direction at half-speed $N_0/2$. Different ratios between the respective running speeds of the two pumps and that of the engine could be obtained by modifying the ratios of the differential. For the same purpose, it would also be possible to utilize an epicycloidal differential with straight pinions; in this case, if we designate by D1 and D2 the respective diameters of the small toothed rim and the large toothed rim of the epicycloidal differential, the speeds of the three axes of the differential are connected to one another by the linear relationship:

$$N3 = \frac{D1}{D1 + D2} \cdot N1 + \frac{D2}{D1 + D2} \cdot N2,$$

in which N3 designates the algebraic value of the rotation speed of the spider pinion system. The geared pumps 3*b* and 3*c* could be replaced by other rotary pumps, for example pumps with barrel piston-chambers or centrifugal pumps, connected however to trap valves to prevent an inversion in the flow in a stopped pump. It would also be possible to utilize two pumps of different types in the same system. The hydraulically controlled brakes could be replaced, for example, by electromagnetic brakes controlled, as has already been indicated, by the electrical signals of a threshold pressure detector of a suitable type.

Figure 7:
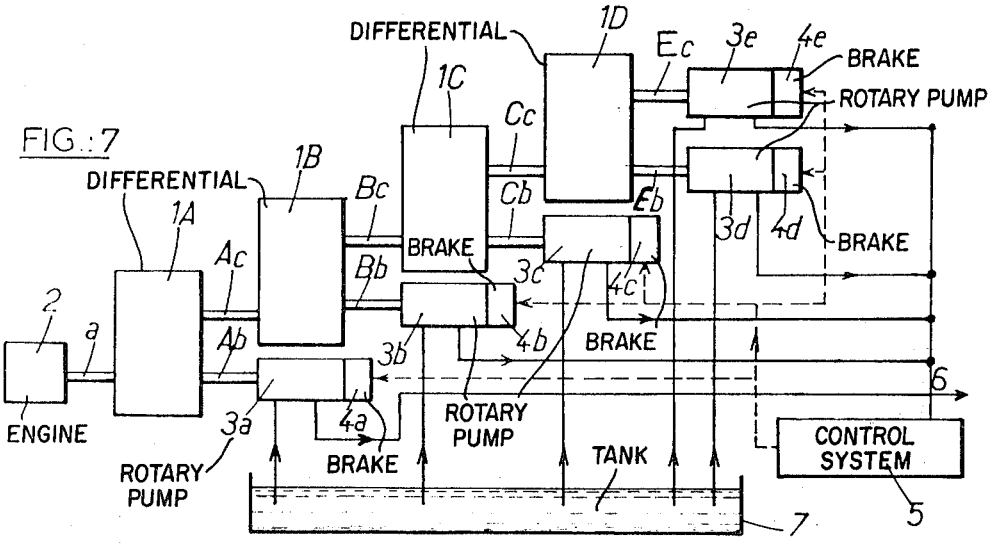
FIG. 7 is a block diagram of a second embodiment making it possible to produce successively hydraulic fluid flows at staggered values, intended for a single utilization circuit.

FIG. 7 illustrates a second embodiment of the invention having four epicycloidal differentials 1A to 1D, which are mounted serially; the first axis a, or intake axis, of the first differential 1A is coupled to the shaft of an engine 2; the second axis, such as Ab (respectively, Bb, Cb, Eb) of each of the differentials, such as 1A (respectively 1B, 1C, 1D) is coupled to the axis of a rotary pump such as 3*a* (respectively 3*b*, 3*c*, 3*d*), while its third axis, such as Ac (respectively Bc, Cc) is coupled to the first axis, or intake axis, of the following differential according to the series, for example 1B (respectively 1C, 1D) with the exception of the third axis Ec of the last differential 1D in the series, which is coupled to the shaft of a rotary pump 3*e*. Connected to the differential pumps 3*a* to 3*e* are respectively the brakes 4*a* to 4*e*, for example of an electromagnetic type. The intakes of the pumps 3*a* to 3*e* are fed by suitable pipes from hydraulic liquid reservoirs which may be provided in numbers equal to those of the pumps, or grouped together in a common tank 7. The pressurizations of the different pumps 3*a* to 3*e* are joined by suitable pipes to the intake 6*a* of the utilization circuit 6; an off-take from the high pressure pipe of the five pumps ends in a control system 5 from which electrical lines (dashed lines) lead for transmitting electrical control signals to the various electromagnetic brakes 4*a* to 4*e*. The automatic control system 5 is susceptible to many known embodiments adapted to the application contemplated in each case. It is programmed in a known manner so that the different pumps 3*a* to 3*e* successively produce hydraulic fluid flows at staggered values intended for the utilization circuit 6; of course the nominal flow of each of the pumps 3*a* to 3*e* is adapted to the value of the flow which it is to send into the utilization circuit. In this embodiment, the automatic control system is arranged so as to produce simultaneously the application of the brakes connected to all the pumps, with the exception of one, the brake of which can then be applied at a programmed moment, at the same time that the brake of one of the other pumps is immediately released; this latter switching is set off by the automatic system 5 when the threshold pressure detector is incorporated into it, and which detects the pressure rise of the pump then in service passing a given threshold in increasing or decreasing values, as previously described regarding the first embodiment.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A system for successively producing hydraulic fluid flows at staggered values, said system comprising:

a single engine;

a mechanical transmission having at least two output shafts and at least one epicycloidal differential, one said at least one differential having an intake axis coupled to said engine;

a hydraulic fluid tank;

at least two rotary pumps having staggered nominal flow values, each of said pumps having mechanical intakes coupled by mechanical links to one of said output shafts of said transmission, fluid intakes connected to said fluid tank and fluid outputs;

brake means connected to each of said pumps;

means for successively controlling each of said brake means, said means for controlling including pressure detector means for determining the pressure of fluid at the discharge side of said pumps, whereby each of said pumps is successively switched between stopping and running as a function of a threshold differential pressure; and fluid circuits connecting said pumps to said pressure detector means.

2. The system of claim 1 wherein said at least one differential comprises only one differential, wherein said at least two pumps comprise only two pumps having outputs connected in parallel to said utilization circuit, and wherein said means for determining the pressure differential is constructed and adapted to measure the pressure in the inlet of said utilization circuit.

3. The system of claim 2 wherein said means for determining the pressure differential includes a threshold pressure detector in said inlet of said utilization circuit, said means for controlling being constructed and adapted to apply the first brake means associated with a first of said two pumps and release the second brake means associated with the second of said two pumps when said threshold pressure detector detects an increasing pressure reaching a first threshold value, and to release said first brake means and apply said second brake means when said threshold pressure detector detects a decreasing pressure reaching a second threshold pressure no greater than said first threshold pressure.

4. The system of claim 3 wherein said means for controlling is constructed and adapted to simultaneously apply one of said first and second brake means and release the other of said first and second brake means.

5. The system of claims 3 or 4 wherein said means for controlling includes a pressure switch comprising:

a housing;

a slide valve movable in said housing;

a first chamber in one end of said housing and subject to the pressure in said inlet of said utilization circuit;

a second chamber in the other end of said housing; and a spring in said second chamber, said spring biasing said slide valve towards said first chamber in opposition to the utilization circuit pressure in said first chamber.

6. The system of claim 5 including means for increasing the effective area of said first chamber after said slide valve has begun to move towards said second chamber.

7. The system of claim 2 wherein said transmission, said pumps and said brake means are formed as a unit within a single housing.

8. The system of claim 7 wherein said two output shafts of said transmission are coaxial, one of said two output shafts being tubular and shorter than the other of said two output shafts, and wherein said two pumps are spaced along the axis of said two output shafts.

9. The system of claims 7 or 8 wherein said brake means comprise a first disk fixed to a first of said two output shafts of said transmission, a second disk fixed to a second of said two output shafts, a first set of packing rings fixed to said housing and a second set of packing rings fixed to a piston movable along the axis of said two output shafts, wherein said disks and packing rings are positioned such that movement of said second set of packing rings in a desired direction contacts one of said second set of packing rings with one of said first and second disks and further movement of said one of said second set of packing rings contacts said one of said first and second disks with one of said first set of packing rings.

10. The system of claim 9 wherein said piston is connected to a single action jack having an adjustable compression drawback spring, and wherein said packing rings are coaxially mounted with said second set of packing rings positioned between said first set of packing rings.

* * * * *

UNITED STATES PATENT AND TRADEMARK OFFICE

CERTIFICATE OF CORRECTION

PATENT NO. : 4,420,289

DATED : December 13, 1983

INVENTOR(S) : SILHOUETTE

It is certified that error appears in the above—identified patent and that said Letters Patent is hereby corrected as shown below:

Col. 5, line 38, after Greek letter "delta",delete "p" and insert therefor --P--.

Col. 8, line 15, delete "1 13h," and insert therefor --13h,--;

line 21, delete "valve" and insert therefor --value--.

Col. 9, line 67, delete "motor" and insert therefor --rotor--.

Col. 10, line 59, delete "differential" and insert therefor --different--.

Signed and Sealed this

*Seventeenth* Day of *July 1984*

[SEAL]

*Attest:*

GERALD J. MOSSINGHOFF

*Attesting Officer*

*Commissioner of Patents and Trademarks*